US006862755B1

(12) United States Patent
Crachy

(10) Patent No.: US 6,862,755 B1
(45) Date of Patent: Mar. 8, 2005

(54) POOL TRAY

(76) Inventor: Pamela J. Crachy, 3643 Nebraska Dr., Hammond, IN (US) 46323

( * ) Notice: Subject to any disclaimer, the term of this patent is extended or adjusted under 35 U.S.C. 154(b) by 0 days.

(21) Appl. No.: 10/621,828

(22) Filed: Jul. 18, 2003

(51) Int. Cl.[7] ..... E04H 4/00
(52) U.S. Cl. ..... 4/496; 4/498
(58) Field of Search ..... 4/496, 579, 578.1, 4/494; 108/42, 47, 152; 248/210, 211, 214, 235

(56) References Cited

U.S. PATENT DOCUMENTS 530,349 A * 12/1894 Payne ..... 108/135
2,596,675 A * 5/1952 Giossi ..... 206/77.1
2,932,544 A * 4/1960 Lambert ..... 108/47
4,495,883 A * 1/1985 Hoy ..... 114/343
4,893,363 A * 1/1990 Huff ..... 4/496
4,895,488 A * 1/1990 Dobbins et al. ..... 414/146
6,017,085 A * 1/2000 LaCroix et al. ..... 297/173
6,105,509 A * 8/2000 Altfeder ..... 108/42
6,131,699 A * 10/2000 Leak, Jr. ..... 182/129
6,474,244 B1 * 11/2002 Karpinski ..... 108/42
6,591,763 B2 * 7/2003 Getfield ..... 108/44
2003/0066462 A1 * 4/2003 Getfield

* cited by examiner

*Primary Examiner*—Gregory L. Huson
*Assistant Examiner*—Khoa Huynh
(74) *Attorney, Agent, or Firm*—Kajane McManus

(57) ABSTRACT

The pool tray has a horizontal surface having a perforations therein for allowing water to drain therefrom. The tray engages over a lip of the pool and is supported against a sidewall of the pool to maintain horizontal positioning. A cover which may be removable or hingedly fixed to the tray may be provided.

2 Claims, 1 Drawing Sheet

10
12
14
16
18
20
22
24
26
28
30
32
34
38

10
12
14
16
18
20
26
32
34

10
14
18
20
26
32
34
40

10
12
14
16
18
20
26
32
34
40
42
44

POOL TRAY

BACKGROUND OF THE INVENTION

1. Field of the Invention

The invention comprises a pool tray which engages over a lip of the pool and is supported against the sidewall thereof to maintain a horizontal position. The pool tray surface is perforated for water to drain therefrom; has an elevated marginal lip to retain items placed thereon, and if desired may incorporate a cover to maintain items on the tray from being splashed.

2. Prior Art

Heretofore various embodiments of pool trays have been proposed. Some incorporate solid planar trays and some incorporate grooved trays for retaining water in the grooves rather than on the tray surface. However, none have been found to have perforations for water drainage or to incorporate a cover.

SUMMARY OF THE INVENTION

Accord to the invention there is provided a pool tray for holding items along a top edge of a pool for accessibility from within the pool, the tray comprising a planar horizontal platform including an upstanding peripheral rim and perforations in the platform for allowing water drainage from the platform and a base engaged to the platform, the base having a first pair of legs each having a hook thereon for engaging a lip of the pool and having a second pair of legs angulated downwardly from the platform to end resting against a sidewall of the pool to maintain the platform horizontally disposed.

DESCRIPTION OF THE PREFERRED EMBODIMENTS

Figure 1:
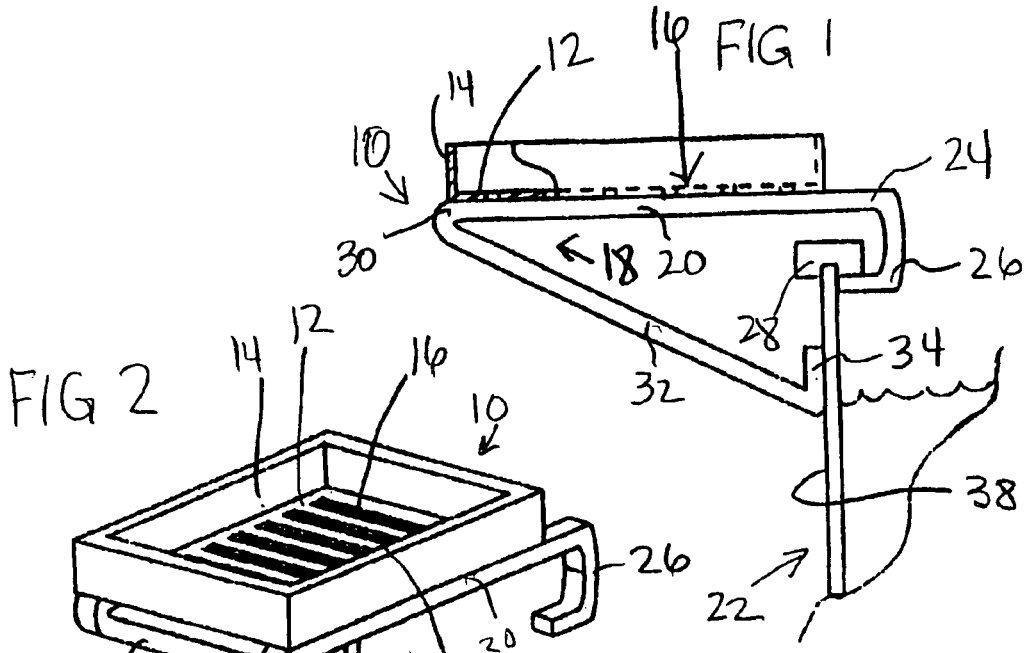
FIG. 1 is a side view showing the tray engaged to a sidewall of a pool.

Referring to the drawings in greater detail there is illustrated therein a pool tray made in accordance with the teaching's of the present invention and generally identified by the reference numeral 10.

The tray 10 is seen to incorporate a planar platform 12 having an upstanding peripheral rim 14 therearound. The platform 12 incorporates a plurality of perforations 16 therein which extend through the full thickness of the platform 12 to allow for drainage of water therethrough.

The platform 12 is fixedly seated upon a base 18, and more precisely upon a first pair of spaced apart legs 20 which are horizontally disposed when engaging the tray 10 to a pool 22.

It will be seen that each of the legs 20 has a free end 24 extending outwardly from beneath the platform 12 and terminates in a hook 26 which engages over a lip 28 of the pool 22, as shown in FIG. 1.

Another end 30 of each of the first pair of legs 20 has a second leg 32 depending therefrom at a downwardly disposed angle, toward the free end 24 of the first leg 30. Each second leg 32 terminates in a upstanding flange 34 which, when the tray 10 is mounted to the pool 22, abuts against an outer surface 38 of the pool 22 bracing the tray 10 against sagging when any items are placed thereon.

It will be understood, of course, that the second pair of depending legs 32 will be shorter than the first pair of legs 20 which must extend into the pool 22, rather than stopping at the sidewall 38 thereof.

Also, it is contemplated to provide a cover 40 for engagement over the platform 12, such as, for example, when a cell phone (not shown) or the like is preferably to be kept from being splashed.

Figure 3:
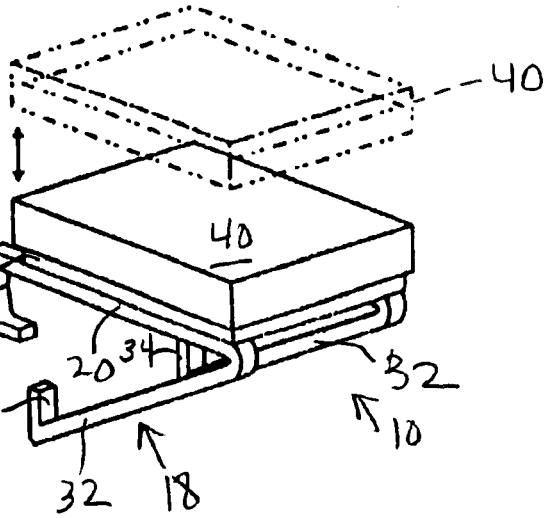
FIG. 3 is a perspective view of the tray showing a removable cover thereof.
Figure 4:
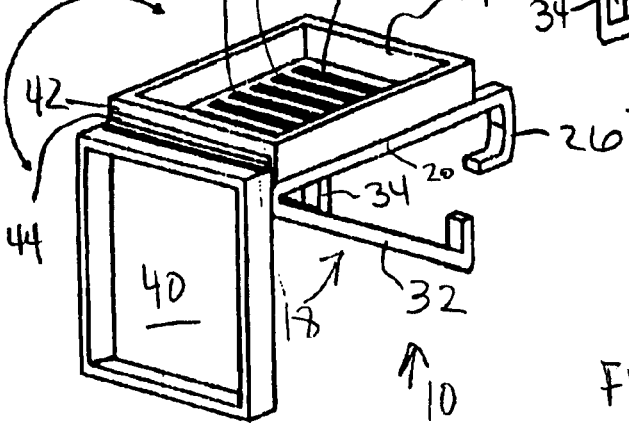
FIG. 4 is a perspective view of the tray showing a cover thereof hingedly engaged to the tray.

The cover 40 as shown in FIG. 3, may merely lift off the platform 12 or, as shown in FIG. 4, may be hingedly fixed to an edge 42 of the tray 10 facing away from the pool 22, by a hinge 44, so the cover 40 can be pivoted between open and closed positions.

As described above the pool tray 10 has a number of advantages, some of which have been described above and others of which are inherent in the invention. Also modifications may be proposed to the pool tray 10 without departing from the teachings herein. Accordingly, the scope of the invention is only to be limited as necessitated by the accompanying claims.

I claim:

1. A pool tray for holding items along a top edge of a pool for accessibility from within the pool, the tray comprising a planar horizontal platform including an upstanding peripheral rim and perforations in the platform for allowing water drainage from the platform and a base engaged to the platform, the base having a first pair of legs each having a hook thereon for engaging a lip of the pool and having a second pair of legs angulated downwardly from the platform to end resting against a sidewall of the pool to maintain the platform horizontally disposed and including a cover hingedly fixed to an edge of the tray which faces away from the pool.

2. A pool tray for holding items along a top edge of a pool for accessibility from within the pool, the tray comprising a planar horizontal platform including an upstanding peripheral rim and perforations in the platform for allowing water drainage from the platform and a base engaged to the platform, the base having a first pair of legs each having a hook thereon for engaging a lip of the pool and having a second pair of legs angulated downwardly from the platform to end resting against a sidewall of the pool to maintain the platform horizontally disposed and including a removable cover which engages said rim and rests on the platform when positioned thereover.

* * * * *

UNITED STATES PATENT AND TRADEMARK OFFICE

CERTIFICATE OF CORRECTION

PATENT NO. : 6,862,755 B1
DATED : March 8, 2005
INVENTOR(S) : Pamela J. Crachy

It is certified that error appears in the above-identified patent and that said Letters Patent is hereby corrected as shown below:

The title page, showing illustrative figure, should be deleted and substitute therefore the attached title page.

Delete Figures 1-4 and substitute therefore the drawing sheets, consisting of Figures 1-4 shown on the attached pages.

Column 2,
Lines 46 and 47, delete "hingedly fixed to an edge of the tray which faces away from the pool." and replace with -- hingedly fixed to an edge of the tray. --

Signed and Sealed this

Fifth Day of April, 2005

JON W. DUDAS
*Director of the United States Patent and Trademark Office*

(12) United States Patent
Crachy

(10) Patent No.: US 6,862,755 B1
(45) Date of Patent: Mar. 8, 2005

(54) POOL TRAY

(76) Inventor: Pamela J. Crachy, 3643 Nebraska Dr., Hammond, IN (US) 46323

( * ) Notice: Subject to any disclaimer, the term of this patent is extended or adjusted under 35 U.S.C. 154(b) by 0 days.

(21) Appl. No.: 10/621,828

(22) Filed: Jul. 18, 2003

(51) Int. Cl.[7] ..... E04H 4/00
(52) U.S. Cl. ..... 4/496; 4/498
(58) Field of Search ..... 4/496, 579, 578.1, 4/494; 108/42, 47, 152; 248/210, 211, 214, 235

(56) References Cited

U.S. PATENT DOCUMENTS 530,349 A * 12/1894 Payne ..... 108/135
2,596,675 A * 5/1952 Giossi ..... 206/77.1
2,932,544 A * 4/1960 Lamberl ..... 108/47
4,495,883 A * 1/1985 Hoy ..... 114/343
4,893,363 A * 1/1990 Huff ..... 4/496
4,895,488 A * 1/1990 Dobbias et al. ..... 414/146
6,017,085 A * 1/2000 LaCroix et al. ..... 297/173
6,105,509 A * 8/2000 Altfeder ..... 108/42
6,131,699 A * 10/2000 Leak, Jr. ..... 182/129
6,474,244 B1 * 11/2002 Karpinski ..... 108/42
6,591,763 B2 * 7/2003 Getfield ..... 108/44
2003/0066462 A1 * 4/2003 Getfield

* cited by examiner

*Primary Examiner*—Gregory L. Huson
*Assistant Examiner*—Khoa Huynh
(74) *Attorney, Agent, or Firm*—Kajane McManus

(57) ABSTRACT

The pool tray has a horizontal surface having a perforations therein for allowing water to drain therefrom. The tray engages over a lip of the pool and is supported against a sidewall of the pool to maintain horizontal positioning. A cover which may be removable or hingedly fixed to the tray may be provided.

2 Claims, 1 Drawing Sheet

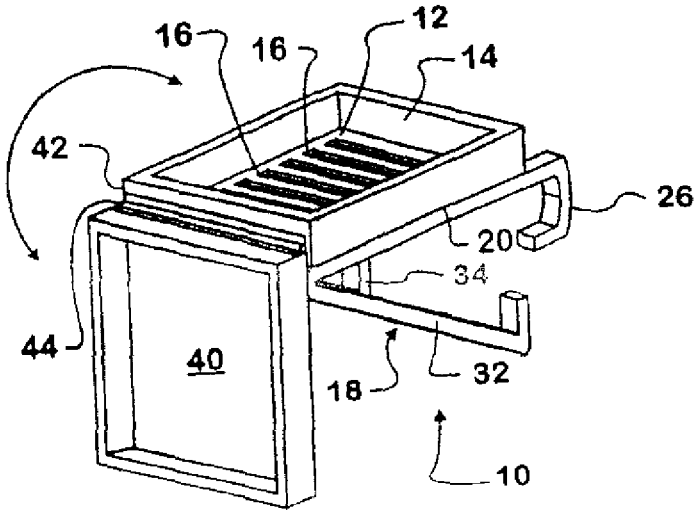

Figure 2:
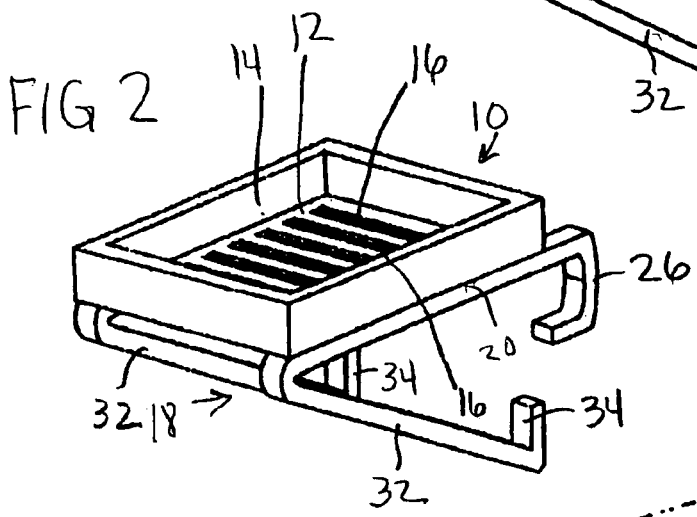
FIG. 2 is a perspective view of the tray.

U.S. Patent Mar. 8, 2005 6,862,755 B1
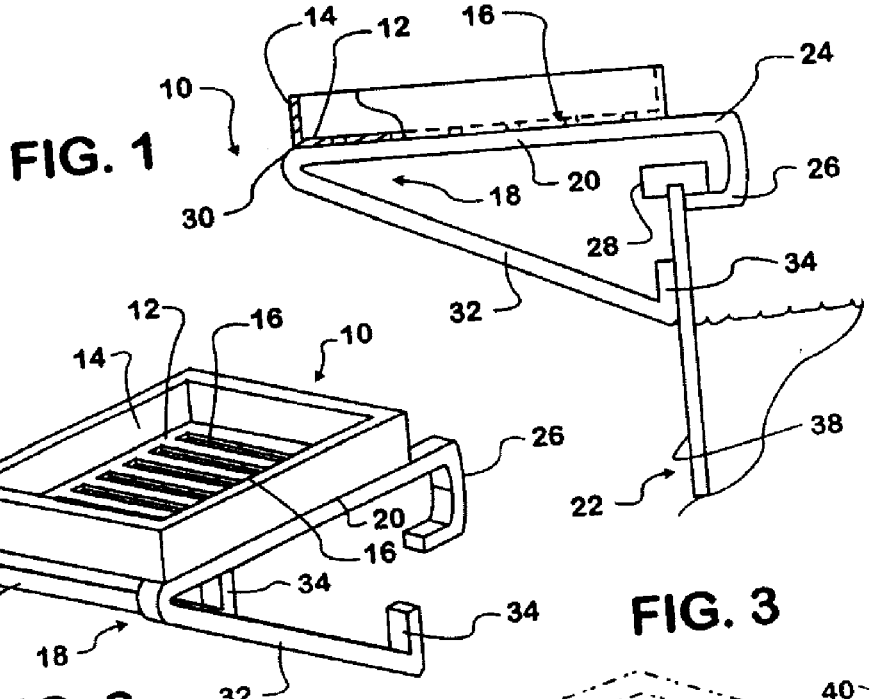
FIG. 1
FIG. 3
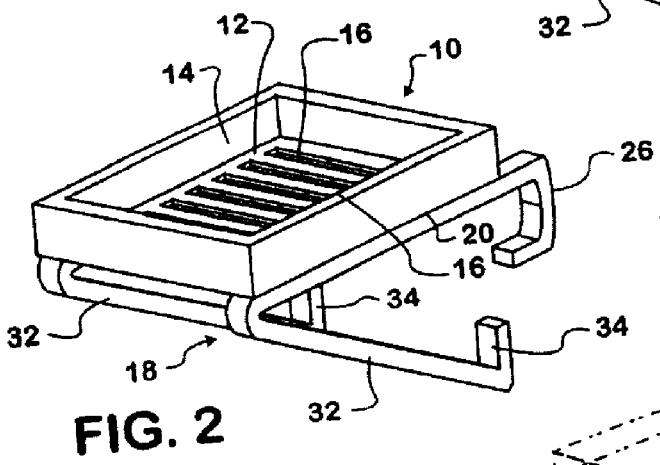
FIG. 2
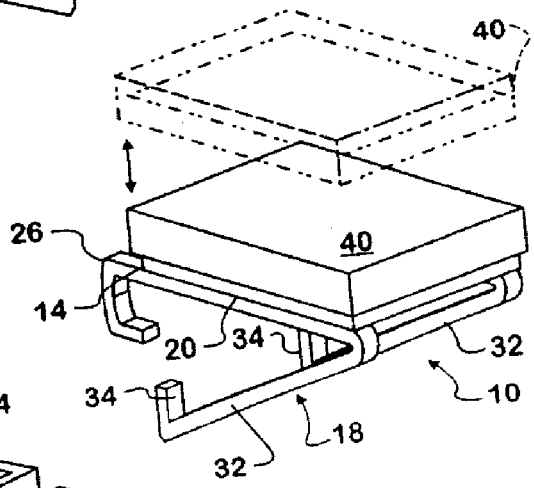
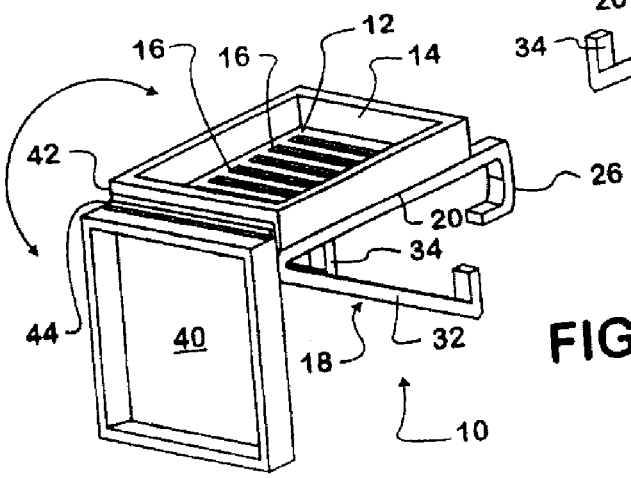
FIG. 4